United States Patent [19]

Botka

[11] Patent Number: 4,648,683

[45] Date of Patent: Mar. 10, 1987

[54] ADJUSTABLE LENGTH SLOTLESS FEMALE CONTACT FOR CONNECTORS

[75] Inventor: Julius Botka, Santa Rosa, Calif.

[73] Assignee: Hewlett-Packard Company, Palo Alto, Calif.

[21] Appl. No.: 738,632

[22] Filed: May 28, 1985

[51] Int. Cl.[4] ..... H01R 17/18

[52] U.S. Cl. ..... 339/177 R; 339/179; 339/256 RT

[58] Field of Search ..... 339/177 R, 177 E, 177 L, 339/178, 179, 241, 242, 89 C, 90 C

[56] References Cited

U.S. PATENT DOCUMENTS

| | | | |
|---|---|---|---|
| 2,757,351 | 7/1956 | Klostermann | 339/177 R |
| 3,275,970 | 9/1966 | Johanson et al. | 339/177 R |
| 3,453,376 | 7/1969 | Ziegler et al. | 339/177 R |
| 3,609,637 | 9/1971 | Cole | 339/177 R |
| 3,660,804 | 5/1972 | Bebber | 339/177 R |
| 4,355,857 | 10/1982 | Hayward | 339/177 R |

*Primary Examiner*—Gil Weidenfeld
*Assistant Examiner*—David L. Pirlot
*Attorney, Agent, or Firm*—John A. Frazzini

[57] ABSTRACT

A connector having a center conductor contact whose length relative to an enclosing outer conductor contact can be adjusted to make a shoulder of the center conductor contact flush with the end of the outer conductor contact. In a female version of the connector, a cylindrical shell encloses a cavity in which a collette is inserted. An opening in a first end of the shell enables a male center pin to be inserted into the connector to make contact with the collette. The collette shape is such that the contacts between the collette and both the shell and the center pin are substantially at the opening of the first end of the shell. A spring on the other end of the collette presses the collette against the shell to produce wiping contacts at the opening.

11 Claims, 11 Drawing Figures

ADJUSTABLE LENGTH SLOTLESS FEMALE CONTACT FOR CONNECTORS

BACKGROUND AND SUMMARY OF THE INVENTION

The disclosed invention relates in general to transmission line connectors and more particularly to a center conductor contact that significantly reduces unwanted resonances and changes in the transmission and reflection characteristics. In the reference numerals utilized in the Figures, the first digit of a reference numeral indicates the first Figure in which the element associated with that reference numeral is discussed. In FIGS. 1 and 2 are illustrated an existing transmission line connection that utilizes a male connector and a female connector with a hooded female contact (i.e., the female contact is encircled by a cylindrical shell). The male connector contains an outer conductor contact 11 and a center conductor contact 12. The female connector includes an outer conductor contact 13 that butts up against outer conductor contact 11 or the male connector.

The center conductor contact of the female connector has a cylindrical shell 14 inside of which is fitted a collette 15 having a set of tines 16. The tines are bent somewhat in toward one another so that they are more closely spaced at a first end 17 of the tines than they are spaced at their bases located at a second end 18 of the tines. Center conductor contact 12 has a reduced diameter center pin 19 that is inserted into collette 15 when the male and female connectors are mated. Contact between collette 15 and center pin 19 is at a point 110 located substantially at the first end 17 of collette 15.

Unfortunately, this connector can exhibit resonances in within the useful bandwidth of the connector and therefore degrade performance of these connectors. Because the tines are not parallel, the diameter of collette 15 varies in the region of contact to pin 19 and thereby functions as a tapered transformer. When such a connector is used to connect a precision standard impedance to a transmission line, the transformer action makes the impedance seen by the transmission line different from the actual value of the precision standard's impedance. In addition, the difference between the diameter of the collette at end 17 and at end 18 is dependent on the diameter of the center pin 19 inserted into the collette. Therefore, the amount by which a precision standard load is transformed is dependent of the diameter of the center pin that is inserted into the female connector. This introduces additional variation in the characteristics of the connector. Thus, such a connector is not suitable for use in coupling a precision standard load to a transmission line. Both of these effects are accentuated in female connectors in which a hoodless center conductor contact is used.

High frequency currents are primarily surface currents so that over most of the useful bandwidth of the connectors, current flows on the inner surface of the outer conductor contact and on the outer surface of the inner conductor contact. At the interface between the male and female connectors, the current from the inner conductor of the transmission line flows along the outside of contact 12, inward along the surface of a shoulder 111, along the outer surface of center pin 19 at which point some of the current enters shell 14 and flows back to end 18 of the collette, back along the inner surface of shell 14, outward along an end 112 of the shell and then along the outer surface of shell 14.

The remainder of the current from contact 12 flows directly to an end 112 of shell 14 via the capacitance between shoulder 111 and end 112. Unfortunately, the gap 113 between the tines 16 and the shell 14 is small enough that particulates can move the point of contact between the tines and the shell away from end 18 of the tines. This produces an undesired variability in the amount of impedance encountered by the inner conductor current.

In general, the characteristic impedance $Z_c$ of a transmission line is proportional to ln (b/a) times the square root of u/e where a is the outer diameter of the inner conductor, b is the inner diameter of the outer conductor, u is the magnetic permeability of the medium between the inner and outer conductors, and e is the electric permittivity of the material between the inner and outer conductors. Reflections result at points at which the characteristic impedance changes abruptly. Therefore, to avoid unwanted reflections and resonances, the characteristic impedance should be constant along the transmission line, including at connectors between successive segments of the transmission line. Thus, in an air filled transmission line, ideal transmission would result for the inner diameter of the outer conductor and the outer diameter of the inner conductor both being constant along the length of the transmission line, including at connectors. Unfortunately, this is not always possible. For example, in an air filled transmission line, the inner conductor is kept centered inside of the outer conductor by a set of plastic dielectric beads that are spaced along the transmission line. In order to compensate for the step change in u/e at a bead, the ratio b/a is changed at the bead to hold $Z_c$ constant.

Likewise, in a connector, to avoid reflections, it is necessary to avoid sudden changes in $Z_c$. However, in the connector of FIG. 1, gap 114 introduces a sudden change in $Z_c$ that produces unwanted reflections. Gap 114 arises because shoulder 111 is intentionally recessed relative to end 115 of outer conductor contact 11. If shoulder 111 should project beyond end 115, then center conductor contact 12 would crush the center conductor contact of the female connector when the male and female connectors are mated. To avoid this, shoulder 111 is intentionally recessed a distance on the order of the sum of the tolerances of the length of the center and outer conductor contacts. This assures that shoulder 111 does not project beyond end 115 of outer conductor contact 11.

In accordance with the illustrated preferred embodiment of the disclosed invention, a connector is presented that enables the length of the center conductor contact to be adjusted to make shoulder 111 and end 112 of shell 14 each be flush with end 115. As a result of this, gap 114 is substantially eliminated, thereby substantially eliminating reflections that are caused by that gap. The female connector has an unslotted cylindrical outer shell within which is a collette that makes contact with the center pin of a male connector. At a first end of the cylindrical shell is an opening through which the center pin of the male connector is to be inserted. At this opening, the wall of the cylindrical shell slopes inward at an angle B (measured relative to the axis A of the cylindrical shell). Similarly, at a first end of the collette, the collette tines angle inward at an angle C that is less than B and is preferably at least five degress less than B.

A spring is formed on a second end of the collette opposite to the first end. The spring fits against a shoulder of the shell and pushes the ends of the tines against the sloping inner surface of the shell to produce a wiping contact at each tine. A set of threads inside the collette enable a thin threaded shaft to be inserted through the opening in the shell and screwed into these threads of the collette. By pulling on the shaft, the collette can be removed from the shell to enable the cavity within the shell to be cleaned or to enable the collette to be replaced.

DESCRIPTION OF THE PREFERRED EMBODIMENT

Figure 2:
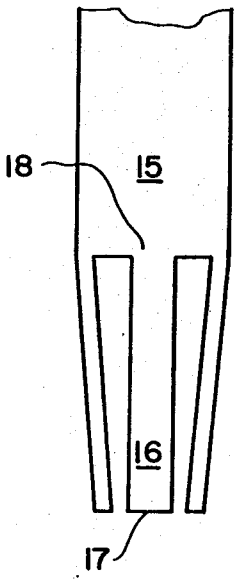
FIG 2 (PRIOR ART)
In FIG. 2 is shown in greater detail a side view of the collette utilized in the female connector of FIG. 1.
Figure 1:
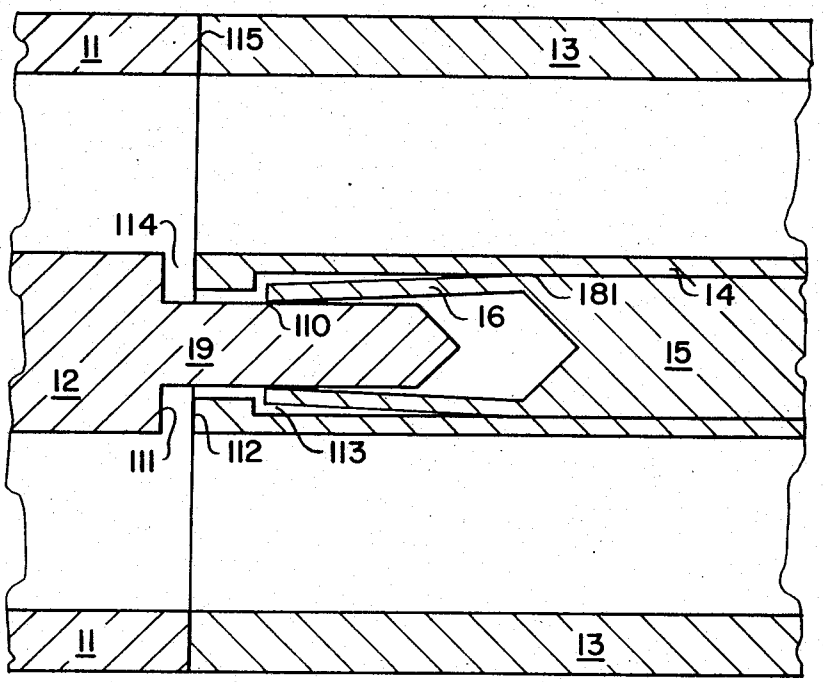
FIG 1 (PRIOR ART)
In FIG. 1 is shown a cross-section of a male and a female connector known in the prior art.
Figure 3:
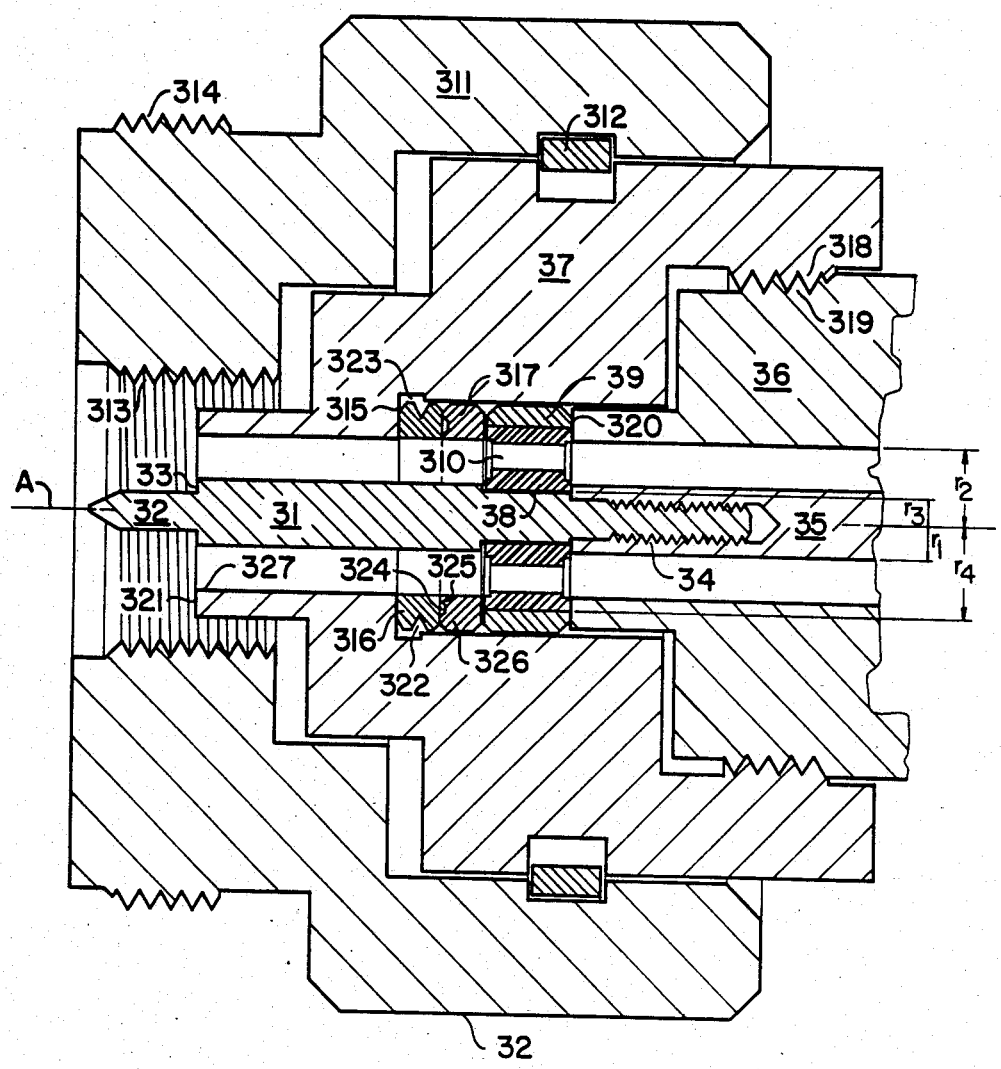
FIG. 3 shows a male connector having an adjustable length center conductor contact.

In FIG. 3 is shown a male connector having an adjustable length center conductor contact 31 of beryllium-copper. On a first end of contact 31 is a reduced diameter center pin 32 that projects forward from a shoulder 33. On a second end of contact 31 opposite end 32 are a set of threads 34 by which contact 31 is attached to a center conductor 35 of a transmission line. Center conductor 35 has radius $r_1$ and is centered within an outer conductor 36 having an inner radius $r_2$. Contact 31 is centered inside of a hardened beryllium-copper outer conductor contact 37 by a plastic bead 38. Encircling the bead is a hardened beryllium-copper ring 39. A set of holes 310 are formed into the bead to make the average dielectric constant of the bead more closely approximate air. At bead 38, the inner radius $r_3$ of ring 39 and the radius $r_4$ of contact 31 are chosen to compensate for the step change in dielectric constant at the bead so that characteristic impedance $Z_c$ at the bead is the same as within the transmission line.

A stainless steel coupling nut 311 is attached to contact 37 by a stainless steel snap ring 312. The coupling nut contains a set of threads 313 for attachment to an associated female connector. A set of threads 314 are also included to enable adapters to be attached to coupling nut 311.

At a shoulder 315, the inner radius of contact 37 is reduced from $r_3$ to the inner radius $r_2$ of the transmission line. Between shoulder 315 and hardened beryllium-copper ring 39 are a soft copper washer 316 and a hardened beryllium-copper washer 317. The length of the inner conductor contact 31 is adjusted by a controlled amount of compression of soft copper washer 316. A set of threads 318 on contact 37 and a set of threads 319 on the transmission line outer conductor 36 enable contact 37 to be threaded onto the transmission line be a controlled amount. As contact 37 is threaded onto outer conductor 36, a first end 320 of conductor 36 presses ring 39 against washer 317. This compresses soft copper washer 316 by an amount determined by the number of turns that contact 37 is threaded onto conductor 36. The number of turns is selected to make shoulder 33 of inner conductor contact 31 flush with an end 321 of outer conductor contact 37.

A notch 322 in the outside surface of copper washer 316 facilitates the compression of that washer. As washer 316 is compressed, it is deformed into an indentation 323 in contact 37. On the inner side of washer 317 facing washer 316 is a notch 324 that produces a knife edge 325 and a wider bump 326 on the side of washer 317. The knife edge ensures that good contact is made between washers 316 and 317 at their inner surfaces of radius $r_2$. This assures that the current from outer conductor 36 can flow along the inner surface of ring 39 and then across the inner surfaces of washers 316 and 317 to the inner surface 327 of contact 37. The dimensions of washers 316 and 317 including the sizes of notch 322 and the width of bump 326 are selected so that the typical amount of force needed to crush washer 316 to make shoulder 33 flush with end 321 is on the order of 50% of the yield strength of threads 318 and 319. This assures that once the length is adjusted that this length will be retained under normal use of the connector. Although the connector shown in FIG. 3 is a male connector, the length of the inner conductor contact of a female connector or of a sexless connector can also be made adjustable in the same manner. In other embodiments, the malleable washer and the hard washer could be located between the bead and a shoulder on inner conductor contact 31. However, it is more advantageous to use a shoulder of outer contact 37 because the shoulder can be larger there. In the case in which a shoulder of the inner contact is used, the bead must have a hard inner ring in contact with the hard washer.

Figure 4:
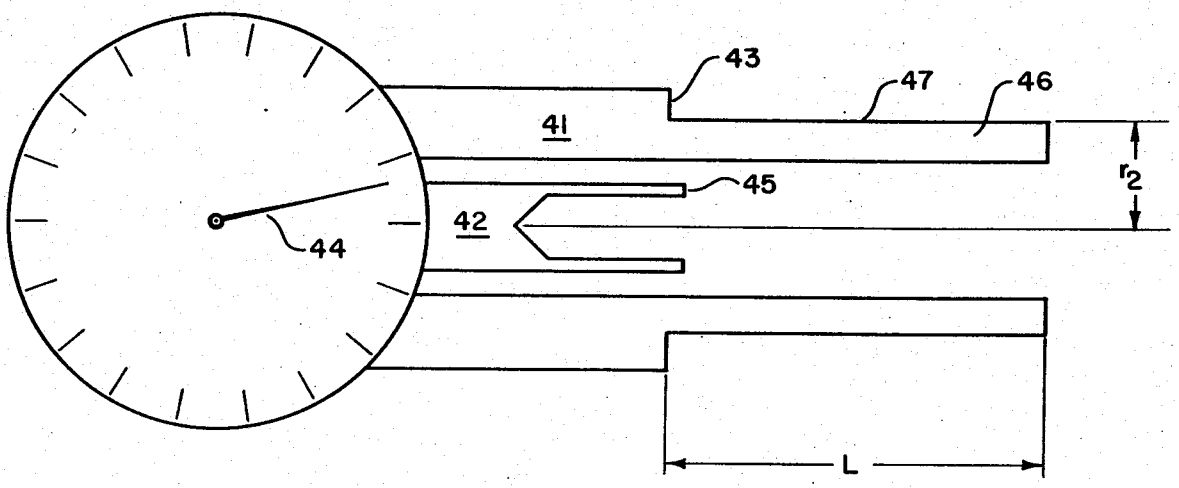
FIG. 4 shows a gauge suitable for use in adjusting the length of the inner conductor contact to be flush with the end of the outer conductor contact.

In FIG. 4 is shown a gauge suitable for use in adjusting the length of the inner conductor contact of connectors of the type shown in FIG. 3. This gauge has a pair of cylindrical sleeves 41 and 42 that are shown in cross-section. Sleeve 41 is rigid and has a shoulder 43 that sits against end 321 of the outer conductor contact 37. Sleeve 42 is movable and is coupled to a pointer 44 of the gauge. End 45 of sleeve 42 sits against shoulder 33 or center conductor contact 31 so that the position of pointer 44 indicates the position along an axis A of shoulder 33 relative to end 321. A portion 46 of sleeve 41 has a length L substantially equal to the distance between shoulder 33 and the nearest edge of plastic bead 38. The radius of portion 46 is slightly less than the inner diameter $r_2$ of inner conductor 36 so that portion 46 fits snugly within outer connector contact 37. As a result of this, when washer 316 is compressed, portion 46 prevents it from bulging inward toward center conductor contact 31. Therefore, a conductive path across washers 316 and 317 is produced at a radius substantially equal to the radius $r_2$ of the inner surface of outer conductor 36.

Figure 5:
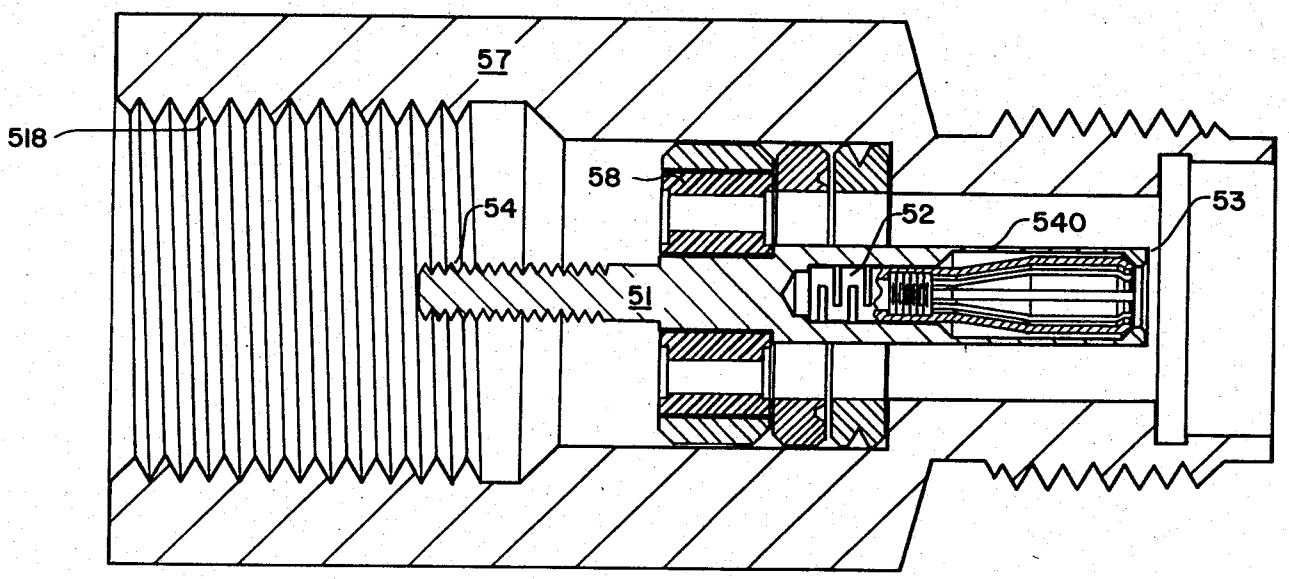
FIG. 5 shows a slotless female connector having an adjustable length center conductor contact.
Figure 6:
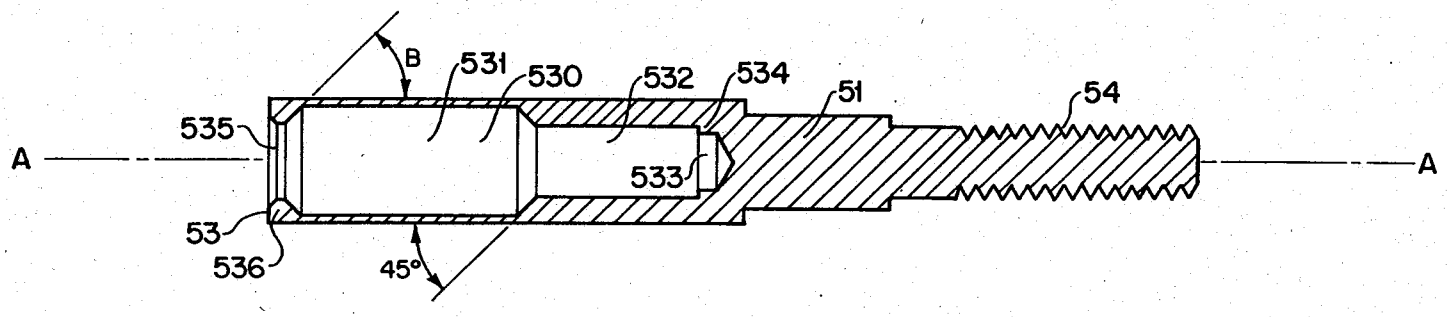
FIG. 6 shows the center conductor contact shell of FIG. 4 in greater detail.

In FIG. 5 is shown an adjustable length slotless female connector. This connector has a shell 51 (shown in greater detail in FIG. 6) and a collette 52 (shown in greater detail in FIGS. 7A–7C). In FIGS. 6 and 7A–7C, the dimensions shown are in inches. In shell 51 is formed a cavity 530 having three cylindrical sections 531–533 of successively decreasing radius. A shoulder 534 is formed at the boundary between sections 532 and 533. Section 531 has an opening 535 at a first end of the shell. Near opening 535, the sidewall of the shell slopes inward (at an acute angle B relative to cylindrical axis A) forming a sloping inner wall 536 at which the collette is to make contact. By an acute angle, is meant that angle B is less than ninety degrees when this angle is measured from the portion of axis A within cavity 530. A set of threads 54 are formed on a second end of the shell opposite to the first end. Threads 54 enable the shell to be screwed into the end of the center conductor of a transmission line.

Figure 7A:
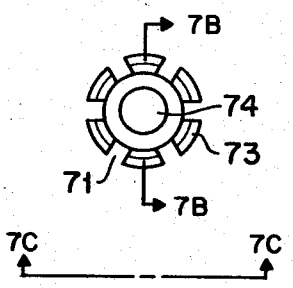
FIGS. 7A–7C show the center conductor contact collette of FIG. 4 in greater detail.
Figure 7B:
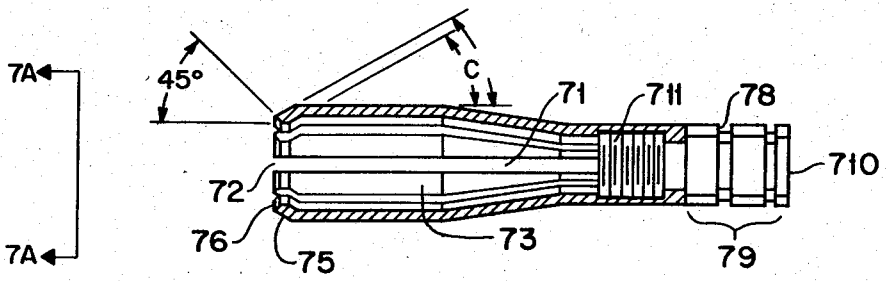
Figure 7C:
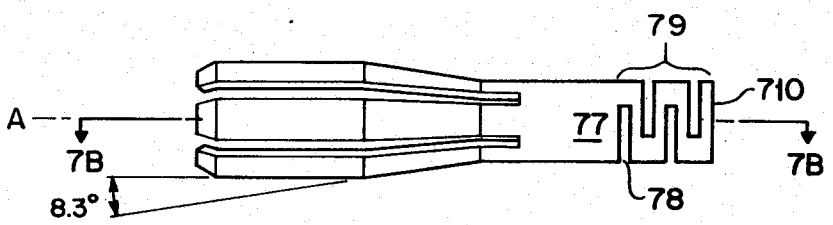

In FIG. 7A is an end view of the collette. In FIG. 7B is a cross-sectional view and in FIG. 7C is a side view as indicated in FIG. 7A. A set of slots 71 extend from a first end 72 of the collette up to a base 77 of the collette to form a set of six tines 73. The tines enclose a cavity 74 into which a center pin 32 of a male connector can be inserted. At end 72, each of the tines slopes inward forming a sloping outer wall 75 an acute angle C (as measured from the portion of axis A within the collette). In this embodiment, angle C is thirty degrees. This slope is greater than the slope of inner wall 536 of the shell so that when the collette is inserted into the shell, contact between the collette and the shell is made at tips 76 of the tines. This assures that, even for center pins having a range of diameters, contact between the collette and the shell occurs within a few thousandths of an inch of opening 535, thereby producing a repeatable impedance at the interface between a male and a female connector.

A set of slots 78 are formed in the base to produce a spring 79. When the collette is inserted into the shell, a base 710 of the spring sits against shoulder 534 of the shell. When the collette is inserted into shell 51, spring 79 and the resilience of the tines cooperate to press the tips 76 of tines 73 against sloping inner wall 536 of the shell. When a center pin 32 is inserted into the collette, spring 79 enables the collette to move slightly further into cavity 74, thereby enabling tips 76 to spread apart to accomodate the center pin. This results in a wiping contact at the point of contact between the tips 76 and sloping wall 536. Because hole 535 will not let oversize or bent center pins into the shell, this protects the collette from damage by such center pins.

Figure 8:
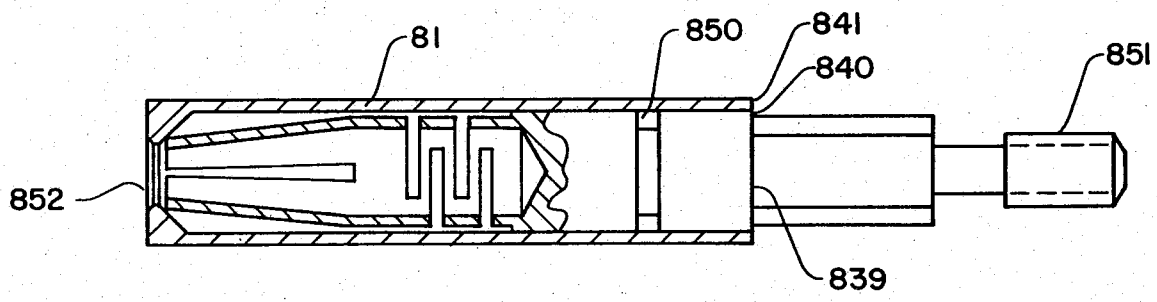
FIG. 8 shows a partially cut-away side view of an alternate embodiment of the slotless female connector center conductor contact.

On the inside surface of the collette are a set of threads 711. This enables the collette to be replaced by inserting a threaded shaft through opening 535 and threading the shaft into threads 711. This enables the collette to be pulled out of the shell through opening 535 so that it can be replaced by another collette. In FIG. 8 is an alternate embodiment of the slotless female center conductor contact. In that embodiment, all parts other than a cylindrical shell 81 are formed as one unitary part. This unitary part is inserted into shell 81 through a hole 839 in the back end 841 of shell 81 until a shoulder 840 of the unitary part is flush with an end 841 of shell 81. A ring 850 of solder is melted to rigidly couple the unitary part to shell 81. A set of threads 851 are included to connect this center connector contact to the center conductor of a transmission line. Because hole 839 is larger than the hole 852 through which a male center pin is to be inserted into this female connector, the unitary part can have a larger diameter than if it had to be inserted through hole 852 as is done for the embodiment in FIG. 5. This design is therefore useful for manufacturing smaller and/or cheaper center conductor contacts than the contacts of the type shown in FIG. 5.

Figure 9:
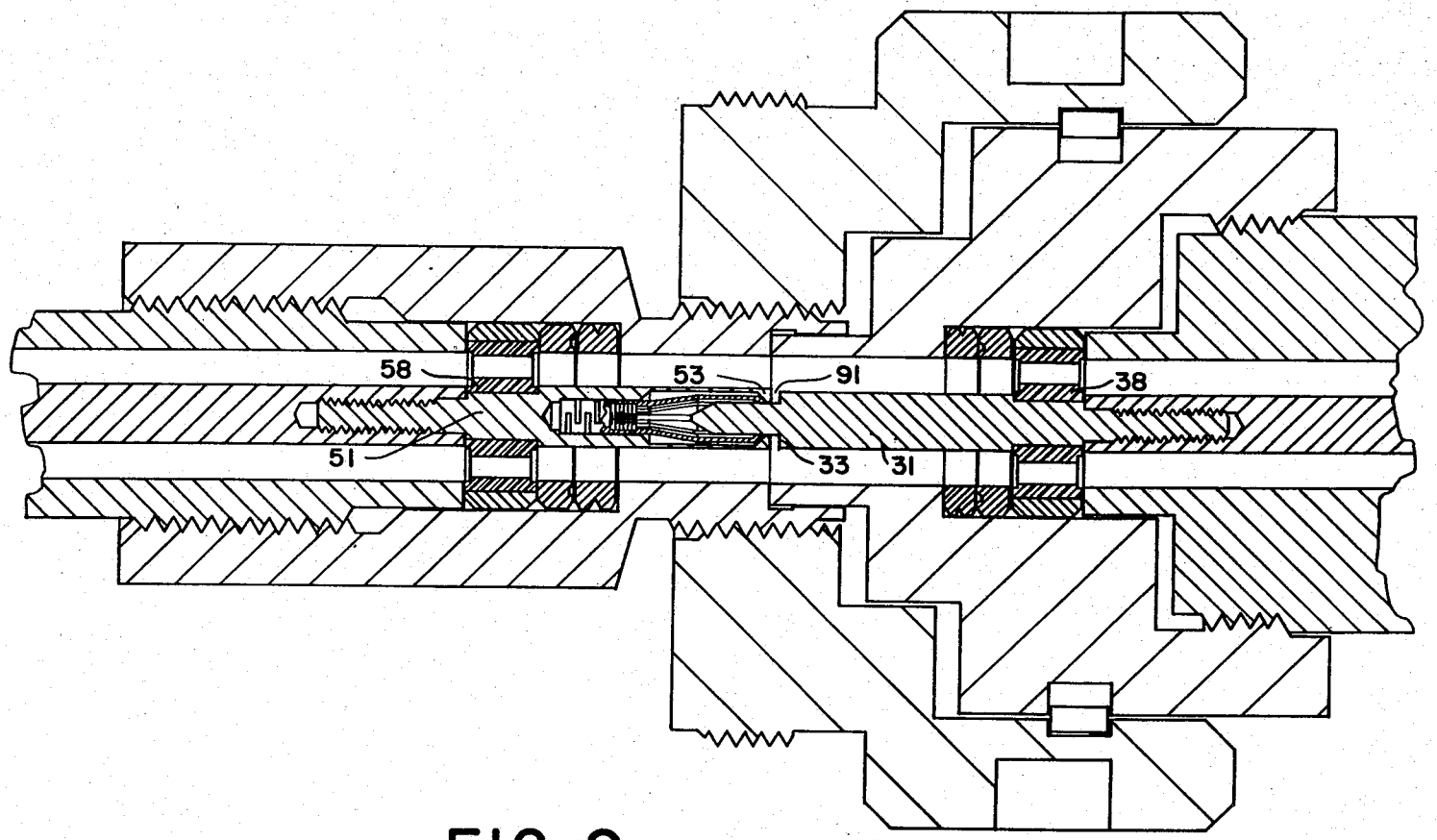
FIG. 9 shows a cross-sectional view of the male connector of FIG. 3 mated to the female connector of FIG. 5.

In FIG. 9 is shown the male connector of FIG. 3 mated to the slotless female connector of FIG. 5. A small gap 91 is shown between shoulder 33 of male center conductor contact 31 and end 53 of female center conductor contact 51. Except for this small gap, the characteristic impedance is constant clear across both connectors. When the center conductor contact of both the male and female connectors are adjusted to be flush, this gap will substantially vanish. Even in the case of a small gap, for the relatively high frequencies typically transmitted across these connectors, the capacitance across the gap substantially shorts end 53 of the female connector to shoulder 33 of the male connector, thereby decreasing the effect of the gap. Thus, the combination of the slotless female contact and the adjustability of the length of the center conductor contact for both connectors produces a constant and calculable characteristic impedance over substantially the entire length of both connectors, thereby significantly reducing reflections and resonances that would otherwise arise.

I claim:

1. A connector comprising:

an outer conductor contact having a first end for making contact with an outer conductor contact of an associated connector, said outer conductor contact having an interior cavity that is connected to an opening in the first end;

a center conductor contact having a first shoulder, said center conductor contact being located within the interior cavity of the outer conductor contact; and plastically deformable means for adjusting the length of the center conductor contact relative to the length of the outer conductor contact to make said first shoulder flush with said end of the outer conductor contact.

2. A connector comprising:

an outer conductor contact having a first end for making contact with an outer conductor contact of an associated connector, said outer conductor contact having an interior cavity that is connected to an opening in the first end;

a center conductor contact having a first shoulder, said center conductor contact being located within the interior cavity of the outer conductor contact; and means for adjusting the length of the center conductor contact relative to the length of the outer conductor contact, whereby the length of the center conductor contact can be adjusted to make said first shoulder flush with said end of the outer conductor contact;

a bead that extends between the outer conductor contact and the center conductor contact to align the center conductor within the interior cavity; said means for adjusting the length of the center conductor contact comprising:

a malleable washer between the bead and a second shoulder of the outer conductor contact; and means for compressing the malleable washer a controlled amount to align said first shoulder flush with said end of the outer conductor contact.

3. A connector as in claim 2 wherein the malleable washer is located between the second shoulder of the outer conductor contact and a ring encircling the bead;

wherein the outer conductor contact has a set of threads adapted to thread onto a set of threads on the end of the outer conductor of a transmission line; and wherein the ring has a radius such that an end of the outer conductor of the transmission line is in contact with the ring when the connector is threaded onto the end of the transmission line, whereby the controlled amount of compression of the ring can be achieved by controlling the number of turns that the outer conductor contact is threaded onto the outer conductor of the transmission line.

4. A method of adjusting the connector of claim 3 comprising the steps of:

inserting through the opening in the first end a gauge having a first shell placed in contact with the first end of the outer conductor contact and a second shell in contact with the first shoulder of the center conductor, the differential movement of the first shell relative to the second shell activating an indicator to indicate the relative amount of movement of one shell relative to the other; and threading the outer conductor onto a transmission line until the indicator indicates that the first shoulder is flush with the first end of the outer conductor contact.

5. A connector as in claim 3 further comprising between the ring and the malleable washer a second washer having a knife edge ring located on its side facing the malleable washer and located at its innermost radius, whereby good electrical contact at the points of least radius of the second washer is assured between the malleable washer and the second washer.

6. A connector as in claim 5 wherein said second washer has sufficient surface area in contact with the malleable washer that the amount of force needed to compress the malleable washer produces a stress on the threads of the outer conductor contact that is on the order of one half the yield strength of the outer conductor contact material.

7. A connector as in claim 1 further comprising a bead that extends between the outer conductor contact and the center conductor contact to align the center conductor within the interior cavity; and wherein said means for adjusting the length of the center contact comprises:

a malleable washer between the bead and a third shoulder of the center conductor contact; and means for compressing the malleable washer a controlled amount to align said first shoulder flush with said end of the outer conductor contact.

8. A connector as in claim 7 wherein the malleable washer is located between the third shoulder of the center conductor contact and a ring encircling the bead;

wherein the outer conductor contact has a set of threads adapted to thread onto a set of threads on the end of the outer conductor of a transmission line; and wherein the ring has a radius such that an end of the outer conductor of the transmission line is in contact with the ring when the connector is threaded onto the end of the transmission line, whereby the controlled amount of compression of the ring can be achieved by controlling the number of turns that the outer conductor contact is threaded onto the outer conductor of the transmission line.

9. A method of adjusting the connector of claim 8 comprising the steps of:

inserting through the opening in the first end a gauge having a first shell placed in contact with the first end of the outer conductor contact and a second shell in contact with the first shoulder of the center conductor, the differential movement of the first shell relative to the second shell activating an indicator to indicate the relative amount of movement of one shell relative to the other; and threading the outer conductor onto a transmission line until the indicator indicates that the first shoulder is flush with the first end of the outer conductor contact.

10. A connector as in claim 8 further comprising between the ring and the malleable washer a second washer having a knife edge ring located on its side facing the malleable washer and located at its innermost radius, whereby good electrical contact at the points of least radius of the second washer is assured between the malleable washer and the second washer.

11. A connector as in claim 10 wherein said second washer has sufficient surface area in contact with the malleable washer that the amount of force needed to compress the malleable washer produces a stress on the threads of the outer conductor contact that is on the order of one half the yield strength of the outer conductor contact material.

* * * * *